United States Patent [19]

Heuss

[11] Patent Number: 4,886,450

[45] Date of Patent: Dec. 12, 1989

[54] COOLED TUBULAR ASSEMBLY FOR INDUSTRIAL REHEATING FURNACE

[75] Inventor: Helmut Heuss, Ratingen, Fed. Rep. of Germany

[73] Assignee: Ruhrgas Aktiengesellschaft, Essen, Fed. Rep. of Germany

[21] Appl. No.: 225,063

[22] Filed: Jul. 27, 1988

[30] Foreign Application Priority Data

Aug. 1, 1987 [DE] Fed. Rep. of Germany ..... 3725607

[51] Int. Cl.[4] ..... F27D 3/00

[52] U.S. Cl. ..... 432/235; 432/236; 432/239

[58] Field of Search ..... 432/121, 235, 236, 239

[56] References Cited

U.S. PATENT DOCUMENTS

| | | | |
|---|---|---|---|
| 1,895,072 | 1/1933 | Fenton et al. | 432/235 |
| 1,927,634 | 9/1933 | Fahrenwald | 432/236 |
| 2,023,126 | 12/1935 | Fahrenwald | 432/239 |
| 3,179,395 | 4/1965 | Esler | 432/239 |

*Primary Examiner*—Henry C. Yuen

*Attorney, Agent, or Firm*—Blakely, Sokoloff, Taylor & Zafman

[57] ABSTRACT

Steel charges are heated to rolling temperature in reheating furnaces. It is standard practice for the charge to be moved through such a furnace on continuous water-cooled tubular supports crossing the furnace in a straight line. The supports obstruct charge heat-up to the desired temperature at the points where the charge is in contact with the tubular supports. A lateral offset of the tubular supports or similar designs have been unable to overcome this disadvantage. The tubular supports of the present reheating furnace are therefore several times offset from a straight line through the furnace between the furnace inlet and the furnace exit or, in the case of a furnace with a fixed hearth in the soaking zone, the furnace inlet and the fixed hearth. Each tubular support section between two such offsets is shorter than the upstream tubular support section. The present arrangement is particularly advantageous for pusher-type furnaces or walking-beam furnaces.

12 Claims, 2 Drawing Sheets

COOLED TUBULAR ASSEMBLY FOR INDUSTRIAL REHEATING FURNACE

BACKGROUND OF THE INVENITON

1. Field of the Invention

The present invention relates to the heat treatment and the reheating of a charge in an industrial furnace and more particularly to a cooled tubular assembly comprising several sections offset relative to each other of different lengths to support said charge as it is moved through said industrial furnace.

1. Prior Art

Reheating furnaces are generally operated to increase the temperature of steel to a level at which the steel may be rolled. Immediately prior to rolling, temperature distribution across the material to be rolled should be as uniform as possible. However, in such a reheating furnace, the temperature of the charge is lower at the points at which said charge rests on water-cooled tubular supports—or on riders frequently placed between such tubular supports and said charge—than at unsupported points of the charge because charge heat-up by burners arranged below such tubular supports is impeded at the points at which said charge so rests on said supports and heat may be transferred from the charge to such water-cooled tubular supports. As the temperature of the charge must also be raised to rolling temperature at said points of supports, a soaking zone is provided for temperature equalization.

Heat transferred to slabs, billets and similar charges passes through the surface of the charge to the core which is heated more slowly. Temperature equalization is thence necessary in such a soaking zone which also ensures a more uniform temperature distribution avoiding relatively cold charge areas at the points where the charge rests on water-cooled tubular supports in the heat-up zone of such a furnace. There are several prior art approaches which seek to improve said temperature distribution.

West German Pat. No. 2 039 507 divulges a cooled tubular assembly comprising a tubular support crossing the furnace in a straight line in the direction of charge travel. Said tubular support is provided with riders arranged one after the other in one line on said support. Said riders are provided with charge-carrying surfaces which are either oblique relative to said tubular support or are arranged in an alternating manner to the left and to the right of the centerline of said tubular support. Said known arrangement of the charge-carrying surfaces of such riders ensures a more uniform heat flow from the charge to the cooled tubular support. However, temperature differentials in such a charge are determined by the position and the size of the entire tubular support with its riders relative to the position and the size of the charge being reheated and said relative position remains unchanged across the entire length of the furnace described in the above West German patent, thereby creating a relatively wide area of relatively low temperature in the charge entering the soaking zone of said furnace.

West German Pat. No. 31 15 930 also describes a reheating furnace provided with a tubular assembly. In the case of said furnace, the tubular supports across 10 to 30 per cent of the furnace length at the exit end of the furnace are jointly displaced laterally relative to the other tubular supports. The tubular supports so displaced are provided with riders. It is the object of the design known from said patent to cause the hot slabs moving directly on tubular supports in the heat-up zone to be carried by riders in the soaking zone of said furnace.

SUMMARY OF THE INVENTION

It is an object of the present invention to provide for more regular and more uniform heat transfer to a charge moved through an industrial reheating furnace immediately on a cooled tubular assembly or on riders placed between such a cooled tubular assembly and the charge reheated in said furnace.

It is also an object of the present invention to propose an arrangement for the cooled tubular assembly in the heating-up zone preceding the soaking zone of such a reheating furnace which minimizes the cooling effect of such water-cooled tubular supports, thereby achieving a substantially complete elimination of temperature differences in the soaking zone of such a furnace.

To achieve said objects, the present invention provides for an industrial reheating furnace comprising a cooled tubular assembly having tubular supports extending in the direction of the furnace centerline from a furnace inlet towards the furnace exit, characterized by at least two tubular support sections offset laterally relative to each other. A first such tubular support section is thence followed by at least one and, if desired, two, three or more tubular support sections, all offset relative to each other, each such section being shorter than the immediately preceding section. The lateral offset of each such section relative to the position of the immediately preceding tubular supports section is at least equal to, but preferably larger than, the tubular support width. The arrangement thereby obtained displaces the area of relatively low charge temperature due to the shielding effect of the tubular supports and any riders thereon by at least the tubular support width at the beginning of each such section, the charge area previously so shielded being directly exposed to the heat.

The first offset section of said tubular support of the tubular assembly is at least partially located in the heating-up zone of the furnace, a certain temperature equalization thus being achieved by a displacement of the area of relatively low charge temperature caused by the shielding effect of the tubular support as the charge is moved through said heating-up zone towards a downstream soaking zone while the second and any further offset sections may be situated in said soaking zone. The arrangement proposed by the present invention thence minimizes temperature differences between the alternating shielded areas of the charge as the charge travels from one tubular support section to the next tubular support section. An alternating arrangement of the lateral offsets proposed by the present invention is preferred, each second such offset resetting the immediately preceding lateral offset.

Calculations suggest that the cooled tubular assembly divulged by the present invention will reduce charge temperature differences by up to 75 percent as compared with a tubular support arrangement without offsets and by up to 25 percent as compared with tubular supports provided with riders.

If a fixed hearth is to be used for the soaking zone, then the last offset tubular support section preferably ends at the beginning of said fixed hearth which may be of the solid unbroken surface design minimizing wear by the charge.

It is advantageous to exploit the present invention for the design of a walking-beam furnace, the walking beams being preferably offset in the same manner as the tubular charge supports and preferably been cooled by water like the tubular supports. The advantages of an offset arrangement of the walking beams are similar to the advantages of the offset tubular support sections described hereinabove, although the time for which said walking beams are in contact with slabs being heated is only relatively short. In the specific case of slabs of a thickness of approx. 250 mm which is common at rolling mills or the like, the reheating furnace may, advantageously, be provided with tubular supports consisting of three tubular support sections offset relative to each other, the length of each such section being substantially one third shorter than the length of the immediately preceding section.

BRIEF DESCRIPTION OF THE DRAWINGS

The present invention is now described in a non-limitative way with reference to the accompanying drawing, in which.

DETAILED DESCRIPTION OF THE INVENTION

The water-cooled tubular supports divulged by the present invention which will now be described in detail with reference to the accompanying drawings may advantageously be used for supporting and, if desired, for moving charge through industrial furnaces. To facilitate the understanding of the present invention, the description relates to furnaces of a given design with given numbers of tubular supports and given furnace zones, but anyone versed in the art will realize that the advantages of a cooled tubular assembly in accordance with the teachings of the present invention may equally be exploited for industrial furnaces of different designs.

Figure 1:
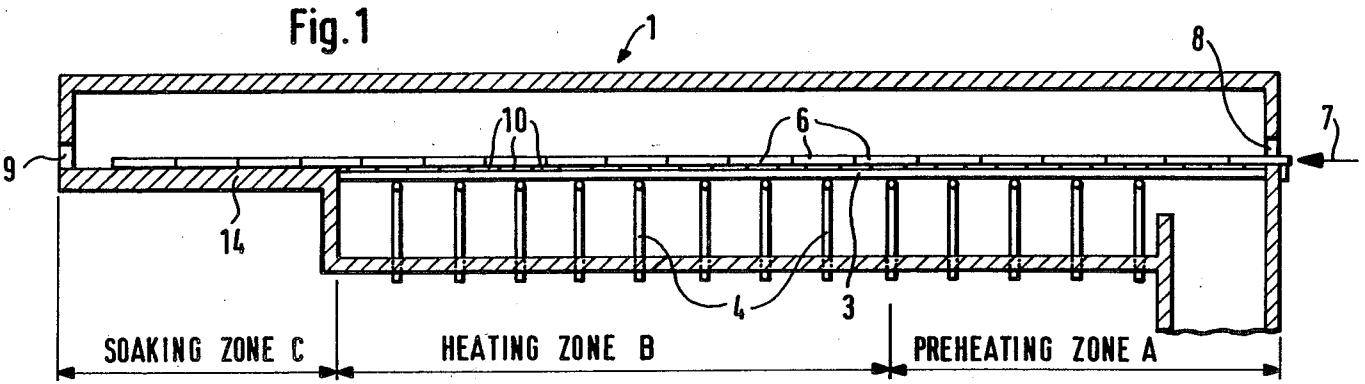
FIG. 1 is a schematic of a longitudinal section of a pusher-type furnace provided with a cooled tubular assembly in accordance with the teachings of the present invention.
Figure 2:
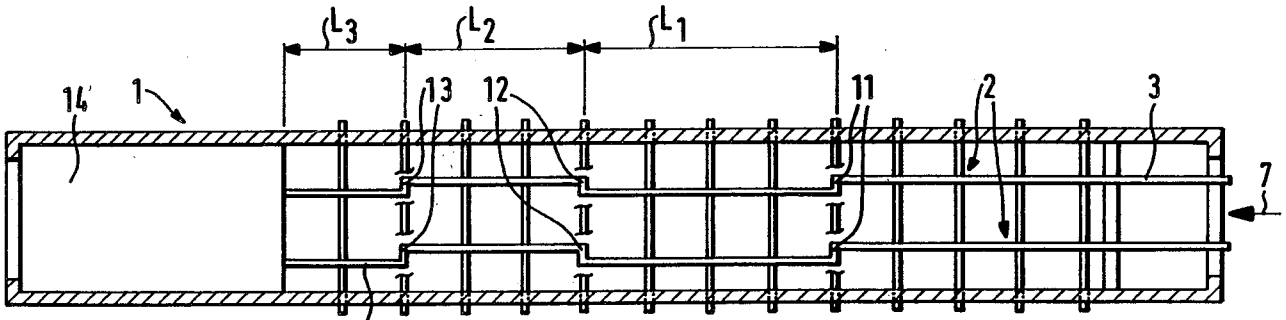
FIG. 2 is a schematic of a longitudinal section displaced by a right angle with respect to the section shown by FIG. 1 showing a top view of said water-cooled tubular assembly, the offset tubular support sections being shown clearly.

FIG. 1 and FIG. 2 show two longitudinal sectional views of a pusher-type furnace (1), displaced relative to each other by a right angle. Said pusher-type furnace (1) is provided with a tubular assembly (2) comprising separate water-cooled tubular supports (3) arranged parallel to each other on vertical standpipes (4). The charge (6) which may be a slab, billet or the like, is moved through said pusher-type furnace (1) in a direction of charge travel (7) on horizontal skids from an inlet (8) to an exit (9) of said pusher-type furnace (1), passing through a preheating zone (A) located adjacent to said inlet (8), a heating-up zone (B) wherein the temperature of said charge is raised to the desired charge temperature, and finally a soaking zone (C) ending at the exit (9) of said pusher-type furnace (1). The tubular charge supports (3) extend continuously from said inlet (8) through said preheating zone (A) and said heating-up zone (B) ending at said soaking zone (C). Said tubular supports (8) are provided with riders (10). In the embodiment of the present invention shown by FIG. 1 and FIG. 2, said pusher-type furnace (1) is provided with a fixed hearth (14) in said soaking zone (C), the floor of said fixed hearth (14) being entirely covered by ceramic material. The skid system created by the surfaces of the riders (10) blends practically without disruption with the surfaces of the ceramic material covering said fixed hearth (14).

As the top view in FIG. 2 shows, the tubular supports (3) follow straight lines parallel to the direction to charge travel (7) in preheating zone (A). As explained hereinabove, areas of relatively low temperature would develop in the charge (6) above the tubular supports (3) and their riders (10) if said tubular supports (3) continued on the same lines through the heating-up zone (B) of said pusher-type furnace (1). It is the teaching of the present invention that the development of such areas of relatively low temperature may substantially be avoided by laterally offsetting sections (S1), (S2) and (S3) of said parallel tubular supports (3) to each other, a first such horizontal offset (11) being situated in the transition area between preheating zone (A) and heating-up zone (B). Said lateral offset (11) is preferably at least of the same length as the width of a tubular support (3). Over the length of section (Sl) determined by design calculations, the tubular supports (3) are displaced in parallel relative to the sections of the tubular supports in preheating zone (A) by the length of the offset (11). Downstream of said first offset (11), said tubular supports (3) are displaced a second time at a second offset (12) realining section (S2) of said tubular supports with the section of said tubular supports situated in preheating zone (A). At a third offset (13) situated at the end of section (S2), said tubular supports (3) are again offset, aligning them again substantially with the tubular support section (S1). As FIG. 2 shows, the lengths of said tubular support sections (S1), (S2) and (S3) differ, sections (S2) and (S3) situated downstream in the direction of charge travel (7) each being substantially one third shorter in a preferred embodiment of the present invention than section (S1) respectively (S2), situated immediately upstream. As mentioned hereinabove, the length of the first offset section (S1) (seen in the direction of charge travel) is determined by design calculations. In the case of slabs of a usual thickness of approx. 250 mm to be reheated to rolling temperature in furnace (1), lengths of 4,500 mm, 3,000 mm and 2,000 mm have been shown to be particularly suitable lengths for tubular support sections (S1), (S2) and (S3) respectively.

Figure 3:
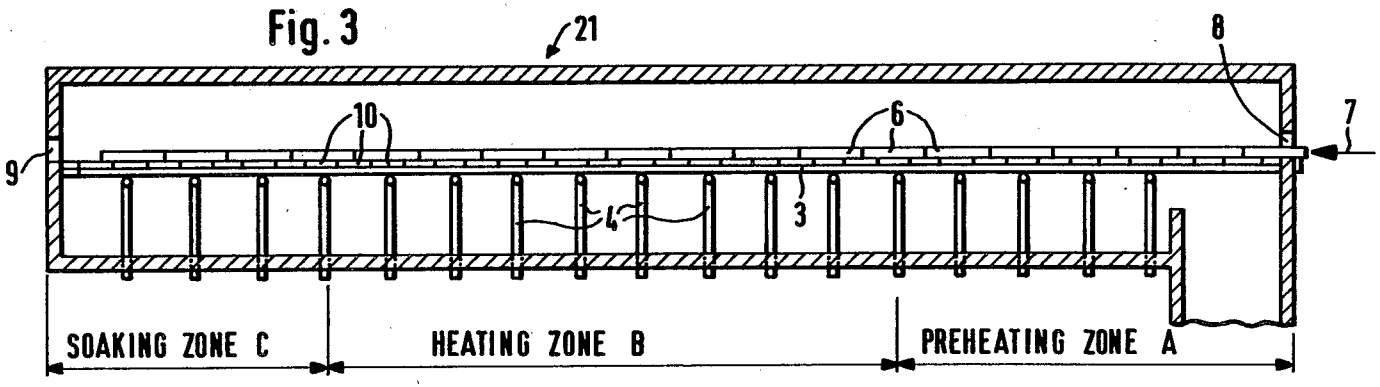
FIG. 3 is a schematic of a longitudinal section similar to the section in FIG. 1 showing a walking-beam furnace designed in accordance with the teachings of the present invention.
Figure 4:
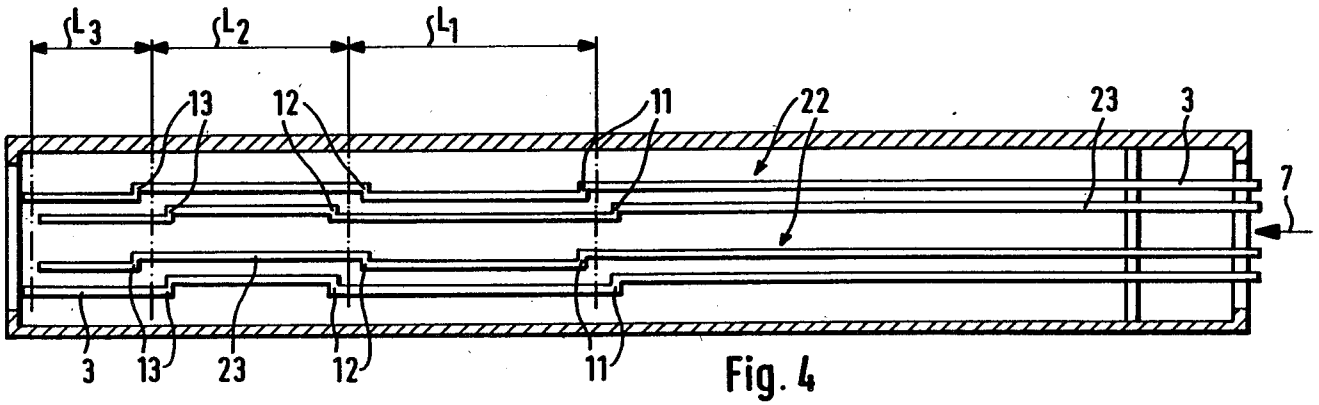
FIG. 4 is a horizontal view of the walking-beam furnace depicted in FIG. 3, showing the offset tubular support sections.

FIG. 3 and FIG. 4 are schematics of a walking-beam furnace (21) also provided with tubular supports (3), standpipes (4), riders (10) and a furnace inlet (8) as well as a furnace exit (9), the same reference numbers as in the description of the pusher-type furnace (1) hereinabove being used as the functions and the design of said elements may be similar to the functions and the design of the corresponding elements of said pusher-tpe furnace (1). As in the case of said pusher-type furnace (1), said walking-beam furnace (21) depicted in FIG. 3 comprises a preheating zone (A), a heating-up zone (B) and a soaking zone (C) in an arrangement and with lengths substantially similar to those described with reference to FIG. 1 hereinabove. In addition to the arrangement of the tubular assembly described with reference to FIG. 1, the tubular assembly (22) of the walking-beam furnace (21) is provided with walking beams (23) which are preferably water-cooled and situated substantially parallel to the tubular supports (3) arranged in the direction of charge travel (7). The mechanism used for driving such walking beams (23) is well known and therefore not depicted in FIG. 3 or in FIG. 4.

As FIG. 4 shows, the tubular supports (3) and the water-cooled walking beams (23) are provided with common paired offsets (11), (12), and (13), dividing said tubular supports (3) and said walking beams (23) into sections (S1), (S2), and (S3) offset laterally relative to each other. Said offsets (11), (12), and (13) are provided for the reasons described hereinabove in the detailed description of the pusher-type furnace (1) depicted in FIG. 1 and FIG. 2 and substantially avoid the formation of areas of relatively low temperature at the points where the charge (6) is in contact with the water-cooled tubular supports and walking beams as it passes through the walking-beam furnace (21).

The embodiment of the present invention shown by FIG. 3 and FIG. 4 does not feature a fixed hearth in the soaking zone, the offset sections (S2) and (S3) therefore being largely situated in the soaking zone (C) adjacent to the exit (9) while the first offset section (S1) and the first portion of the second offset section (S2) are situated in the heating-up zone (B) arranged upstream of said soaking zone (C). The ratios between the lengths of the three offset sections (S1), (S2), and (S3) with (S2) and (S3) being shorter than the immediately preceding sections (S1) and (S2), are similar to the ratios given hereinabove for the embodiment of the present invention described with reference to FIG. 1 and FIG. 2.

As indicated by this detailed description, a preferred embodiment of the present invention features three offset sections of lengths decreasing in the direction of charge travel (7), but two offset sections (S1) and (S2) without a third section (S3) may be sufficient to substantially avoid the formation of areas of relatively low temperature in the charge. On the other hand, in keeping with the teachings of the present invention, the tubular assembly (2) may consist of more than three offset sections of lengths decreasing in the direction of charge travel (7). The number of preferably parallel tubular supports and/or walking beams preferably offset at the same offsets (11), (12), or (13) is not a characteristic of the present invention, the prominent characteristics of which include the arrangement, the sequence and the relative lengths of the offset sections of the tubular supports and any walking beams which may be provided.

The offset tubular support sections (S1), (S2), and (S3) are, according to the teaching of the present invention, at least partly situated in heating-up zone (B), temperature equalization in the charge avoiding the formation of areas of relatively low temperature in the charge thence commencing during charge heat-up in the heating-up zone (B) and not being limited to the charge dwell time in the soaking zone (C). The different lengths of sections (S2) and (S3) proposed by the present invention favour uniform temperature distribution and temperature equalization inside the charge during soaking in soaking zone (C).

I claim:

1. An industrial reheating furnace comprising at least one inlet through which the charge to be reheated enters said furnace, at least one exit through which reheated charge in said furnace leaves said furnace; and means to support said charge as said charge moves through said furnace from said inlet to said exit in a direction of charge travel, said support means consisting of a cooled tubular assembly comprising at least one tubular support entending in said direction of charge travel from said inlet in the direction of said exit and being provided with riders carrying said charge at least over a section of said tubular support, said tubular support having at least two longitudinal sections each being laterally offset relative to said other tubular support section by a distance being at least equal to the width of said tubular support wherein the length of each section so offset downstream with respect to said direction of charge travel is shorter than the length of the immediately preceding upstream support section.

2. An industrial reheating furnace according to claim 1 wherein said cooled tubular support assembly has at least two such tubular supports spaced relative to each other, said tubular supports each having offset sections commencing and ending substantially at corresponding points in said direction of charge travel.

3. An industrial reheating furnace according to claim 2 wherein the last offset tubular support section in said direction of charge travel ends at the exit of said reheating furnace.

4. An industrial reheating furnace according to claim 2 further comprising for soaking a fixed hearth having a solid unbroken support area, said cooled tubular assembly having a last tubular support section in said direction of charge travel ending at said fixed hearth.

5. An industrial reheating furnace according to claim 2 said tubular supports each having three sections offset relative to each other wherein the length of each such offset tubular support section in said direction of said charge travel is substantially one third shorter than the length of each immediately preceding upstream section.

6. An industrial reheating furnace according to claim 1, further comprising a heating-up zone and a soaking zone adjacent to said furnace exit wherein at least one of said offset tubular support sections is situated in said heating zone.

7. An industrial reheating furnace according to claim 6 wherein two adjacent offset tubular support sections are situated in said heating-up zone.

8. A walking-beam furnace for reheating a charge comprising at least one inlet through which said charge enters said furnace, at least one exit through which said charge leaves said furnace, means to transfer said charge through said furnace from said inlet to said exit in a direction of charge travel, said transfer means comprisingwater-cooled walking beams; and a water-cooled tubular assembly having individual tubular supports extending substantially in said direction of charge travel from said inlet to said exit, both said tubular supports and said walking beams having at least two longitudinal sections each being laterally offset to said other section, wherein the length of each section so offset downstream with respect to said direction of charge travel is shorter than the length of the immediately preceding upstream section.

9. A walking-beam furnace according to claim 8, wherein a heating-up zone is followed by a soaking zone adjacent to said exit, said heating-up zone comprising at least the most upstream of said tubular support and walking-beam sections.

10. A walking-beam furnace according to claim 9 wherein said soaking zone comprises at least the most downstream of said tubular support and walking-beam sections.

11. A walking-beam furnace according to claim 9 wherein said tubular supports and said walking beams are each divided into three sections offset relative to each other and the length of each such section in said direction of charge travel is substantially one third shorter than the length of each immediately preceding upstream section.

12. An industrial reheating furnace comprising:

at least one inlet through which the charge to be reheated enters said furnace;

at least one exit through which reheated charge in said furnace leaves said furnace; and means to support said charge as said charge moves through said furnace from said inlet to said exit in a direction of charge travel, said support means consisting of an internally cooled tubular assembly comprising at least one tubular support extending in said direction of charge travel from said inlet in the direction of said exit and being provided with riders carrying said charge at least over a section of said tubular support, said tubular support having at least two longitudinal sections connected together for being commonly cooled, each of said sections being laterally offset relative to said other tubular support section by a distance being at least equal to the width of said tubular support wherein the length of each section so offset downstream with respect to said direction of charge travel is shorter than the length of the immediately preceding upstream support section.

* * * * *